US007717639B2

(12) United States Patent
Zins et al.

(10) Patent No.: US 7,717,639 B2
(45) Date of Patent: May 18, 2010

(54) BINDER

(75) Inventors: Kenneth Zins, Fitchburg, MA (US); Aidan Petrie, Jamestown, RI (US); Daniel Nelsen, Providence, RI (US)

(73) Assignee: Staples The Office Superstore, LLC, Framingham, MA (US)

( * ) Notice: Subject to any disclaimer, the term of this patent is extended or adjusted under 35 U.S.C. 154(b) by 0 days.

(21) Appl. No.: 11/546,028

(22) Filed: Oct. 11, 2006

(65) Prior Publication Data

US 2008/0089737 A1 Apr. 17, 2008

(51) Int. Cl.
*B42D 1/00* (2006.01)
*B42D 3/00* (2006.01)
*B42F 3/00* (2006.01)
*B42F 13/12* (2006.01)

(52) U.S. Cl. ..... 402/73; 281/15.1; 281/29; 281/36; 281/37; 402/3; 402/4; 402/70; 402/80 R; 402/502

(58) Field of Classification Search ..... 402/3, 402/40, 73, 4, 70, 502, 80 R; 40/20, 642.02, 40/700–799, 124.06, 405, 575, 611.01; 281/40, 281/15.1, 22, 29, 31, 32; 24/563, 679; D19/26; 312/234.2; *A47G 1/06, 1/16; B42F 13/00; B65D 85/67; G09F 7/02*

See application file for complete search history.

(56) References Cited

U.S. PATENT DOCUMENTS 1,677,277 A * 7/1928 Federbush et al. ..... 402/3
1,887,530 A 11/1932 Trussell
2,544,566 A 3/1951 Rose
2,616,431 A 11/1952 Kalwajtys
2,704,546 A 3/1955 Slonneger
3,544,230 A * 12/1970 Ohlsson ..... 402/3
3,663,041 A 5/1972 White
3,727,334 A * 4/1973 Sakamoto ..... 40/536
3,807,883 A 4/1974 Karlsson
3,814,527 A * 6/1974 Lawes ..... 402/3
4,164,085 A 8/1979 Steeb et al.
4,172,332 A 10/1979 Holes et al.

(Continued)

FOREIGN PATENT DOCUMENTS

EP 0620126 A1 10/1994

(Continued)

OTHER PUBLICATIONS

International Search Report and Written Opinion from the corresponding International Application No. PCT/US2007/021550 mailed Apr. 28, 2008.

(Continued)

*Primary Examiner*—Dana Ross
*Assistant Examiner*—Justin V Lewis
(74) *Attorney, Agent, or Firm*—Wolf, Greenfield & Sacks, P.C.

(57) ABSTRACT

A binder for holding papers or other objects is described. The binder comprises a window which enables a user to identify the contents of the binder. The outer surface of the window may be substantially flush with the outer surface of the binder. At least one tab may be located behind the window which enables a user to load a label and holds the label such that it is viewable through the window.

20 Claims, 9 Drawing Sheets

U.S. PATENT DOCUMENTS

| | | | | |
|---|---|---|---|---|
| 4,190,374 | A | 2/1980 | Lindell | |
| 4,750,282 | A * | 6/1988 | Zennedjian | 40/792 |
| 5,330,279 | A | 7/1994 | Ruble | |
| 5,368,333 | A * | 11/1994 | Arroyo | 281/31 |
| D354,768 | S | 1/1995 | Muller et al. | |
| 5,383,297 | A * | 1/1995 | Summerville et al. | 40/611.13 |
| 5,441,357 | A | 8/1995 | Wilson | |
| 5,607,246 | A | 3/1997 | Podosek | |
| 5,620,207 | A | 4/1997 | Podosek et al. | |
| 5,711,627 | A | 1/1998 | Chapman | |
| 5,720,564 | A | 2/1998 | Winzen | |
| 5,857,797 | A | 1/1999 | Streff et al. | |
| D407,434 | S | 3/1999 | Moor | |
| 5,876,143 | A | 3/1999 | Ong | |
| D412,530 | S | 8/1999 | Bould | |
| 5,951,189 | A | 9/1999 | Winzen | |
| 6,019,540 | A | 2/2000 | Senior | |
| 6,030,140 | A | 2/2000 | Karten et al. | |
| 6,045,161 | A | 4/2000 | Ashcraft et al. | |
| 6,213,668 | B1 | 4/2001 | Brown et al. | |
| 6,234,701 | B1 | 5/2001 | Karten et al. | |
| 6,290,421 | B1 | 9/2001 | Welch | |
| 6,298,593 | B1 * | 10/2001 | Vilims et al. | 40/768 |
| 6,302,443 | B1 | 10/2001 | Ashcraft et al. | |
| 6,305,714 | B1 | 10/2001 | Rossetto et al. | |
| 6,361,236 | B1 | 3/2002 | Podosek | |
| 6,364,559 | B2 | 4/2002 | Brown et al. | |
| 6,367,842 | B1 | 4/2002 | Wien et al. | |
| 6,368,005 | B1 * | 4/2002 | Streff et al. | 402/3 |
| 6,371,520 | B1 | 4/2002 | Wolff et al. | |
| D458,634 | S | 6/2002 | Gerriet | |
| 6,478,336 | B2 * | 11/2002 | Tran | 281/29 |
| 6,488,433 | B2 | 12/2002 | Wien et al. | |
| 6,644,882 | B2 | 11/2003 | Brown et al. | |
| 6,695,518 | B2 | 2/2004 | Ruble et al. | |
| 6,761,498 | B1 | 7/2004 | Harris, Jr. et al. | |
| 6,764,242 | B1 * | 7/2004 | Karten et al. | 402/73 |
| 6,769,829 | B1 | 8/2004 | Castillo et al. | |
| 6,854,915 | B1 * | 2/2005 | Ong | 402/3 |
| 6,902,340 | B2 | 6/2005 | Harris, Jr. et al. | |
| D527,764 | S | 9/2006 | Hensley | |
| 2002/0074791 | A1 * | 6/2002 | Wien et al. | 281/37 |
| 2003/0044222 | A1 | 3/2003 | Dahlke et al. | |
| 2003/0213154 | A1 | 11/2003 | Park | |
| 2005/0105960 | A1 | 5/2005 | Wehmeyer | |
| 2005/0179247 | A1 | 8/2005 | Hough et al. | |
| 2006/0055167 | A1 | 3/2006 | Pollman et al. | |

FOREIGN PATENT DOCUMENTS

| | | |
|---|---|---|
| GB | 197292 | 1/1924 |
| GB | 708690 | 5/1954 |

OTHER PUBLICATIONS

International Preliminary Report on Patentability dated Feb. 27, 2009 for corresponding PCT Application No. 2007/021550.

* cited by examiner

BINDER

FIELD

Aspects of the invention relate to binders for holding articles such as paper.

DISCUSSION OF RELATED ART

Binders are employed to hold articles, typically loose-leaf papers, documents, and the like. Labels may be viewable from the outside of the spine or cover(s) in order to identify the contents of the binder to a user.

SUMMARY

According to one aspect of the invention, a binder for retaining an item is provided. The binder includes a first and second panel with a spine connecting the first panel to the second panel. The spine defines a spine outer surface and a cutout. The binder also includes a window substantially in the cutout that defines a window outer surface, where the window outer surface is substantially flush with the spine outer surface. The binder also comprises a first flexible tab connected to the spine that extends at least partially in back of the window.

According to another aspect of the invention, a binder for retaining an item is provided. The binder comprises a first and second panel, each having an outer surface. A spine connects the first panel to the second panel. The spine has an outer surface. A cutout is disposed in at least one of the first and second panels and the spine. The binder also has a window substantially placed in the cutout that defines a window outer surface, wherein the window outer surface is substantially flush with the outer surface of at least one of the first and second panels and the spine.

According to yet another aspect of the invention, a binder for retaining an item is provided. The binder comprises first and second panels and a spine connecting the first and second panels. A cutout is disposed in at least one of the first and second panels and the spine. The binder includes a first flexible tab connected to the at least one of the first and second panels and the spine. The tab extends into the cutout. The binder also includes a window placed substantially in the cutout and at least partially in front of the tab.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
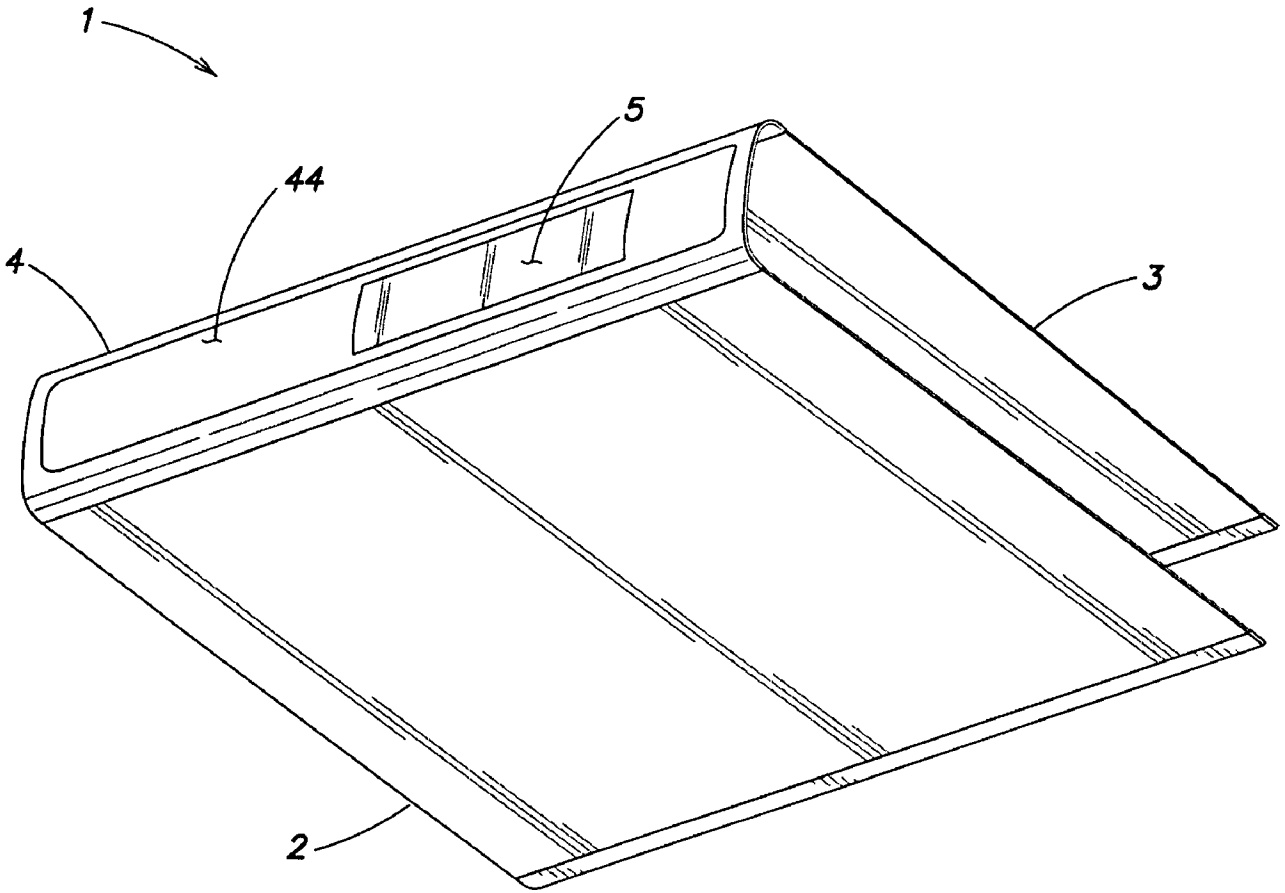
FIG. 1 is a perspective view of one embodiment of a binder.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Aspects of the invention are directed to improved binders constructed to display and retain a label such that it is viewable from the outside of the binder. The binder includes a label display which may be formed of a window that is flush with the outer surface of the binder. The display may comprise at least one recessed tab to hold a label behind the window, and in one embodiment, against the window.

According to one aspect, a binder has a front panel, a back panel, and a spine connecting the front and back panels. The spine includes the label area or label display in the form of a pocket formed between a window and a recessed portion of the spine. The pocket may be accessed and a label may be placed in the pocket to identify the contents of the binder. Although in one embodiment, the label area is formed on the spine, any other locations on the binder may include a label area.

In one aspect, the window may be substantially rigid. The window may be substantially flush with the outer surface of the binder, such as the outer surface of the spine, such that the outer surface of the window is substantially contiguous with and follows the contour of the outer surface of the spine. The binder may be configured such that there are substantially no protruding edges of the window. In this manner, the window is substantially flush with the spine outer surface.

In another aspect, the binder may comprise at least one tab behind the window forming a pocket between the window and the tab. The tab may help hold a label in place behind the window. The tab may have a flexible portion to facilitate loading a label between the window and the tab. The tab may comprise a resilient material such that it is biased toward the window and springs back when flexed. The tab may additionally comprise a finger hold to aid a user in flexing a free end of the tab in order to load a label between the tab and the window. In one embodiment, the tab may be integrally formed with the spine. The outer surface of the tab may be recessed with respect to the outer surface of the rest of the spine in order to create a space for a window to be placed.

In yet another aspect, the binder may be configured such that a label is placed between the window and tab from the interior of the binding. Thus, in order to insert a label so that it can be viewed through the window, the binder is at least partially open.

It should be appreciated that various combinations of the above-described features can be employed together; however the aspects of the present invention are not limited in this respect. Therefore, although the specific embodiments disclosed in the figures and described in detail below employ particular combinations of the above-discussed features, it should be appreciated that the present invention is not limited in this respect, as the various aspects of the present invention can be employed separately, or in different combinations. Thus, the particular embodiments described in detail below are provided for illustrative purposes only.

Turning to FIG. 1, a binder according to one illustrative embodiment is shown. The binder 1 comprises a front panel 2, a back panel 3, and a spine 4. The spine 4 is pivotably connected to both the front 2 and back 3 panels. The binder 1 is configured to hold papers, such as looseleaf 8½ by 11 papers, although other sizes may be used. To accomplish this, the binder 1 comprises a set of rings (not shown) attached to the front panel 2, back panel 3, or to the spine 4. The rings are configured to correspond to the holes in the looseleaf paper(s) and may be of split ring configuration with an operating mechanism that opens the rings. Thus, the rings can be opened to add or remove papers, and closed to retain the papers as is known in the art. Some examples of binders are described in co-pending U.S. application Ser. Nos. 11/301,338 and 11/327,194, which are hereby incorporated by reference in their entirety, although other covers, hinges, and ring configurations may be employed.

Figure 2:
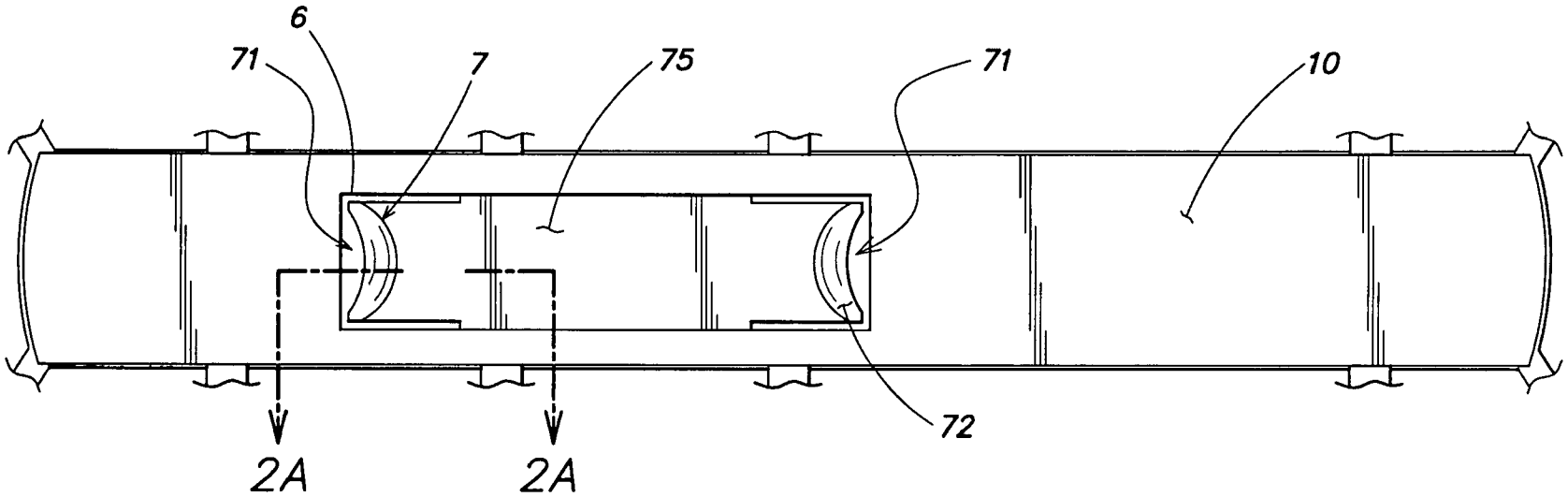
FIG. 2 is a front view of a portion of the spine of the binder shown in FIG. 1.

Continuing with reference to FIG. 1, in one illustrative embodiment, a window 5 is attached to the spine 4. A label (not shown) may be placed behind the window. As shown in FIG. 2, the spine 4 comprises a central section 10. Connectors (not labeled) for attaching the central section 10 to the front 2 and back 3 panels may be employed. Other suitable attachment arrangements for attaching the spine to the front and/or back panels may be employed, as the present invention is not limited in this regard. The central section 10 may have a cutout 6 which defines a space to place a window 5 (not shown).

Figure 4:
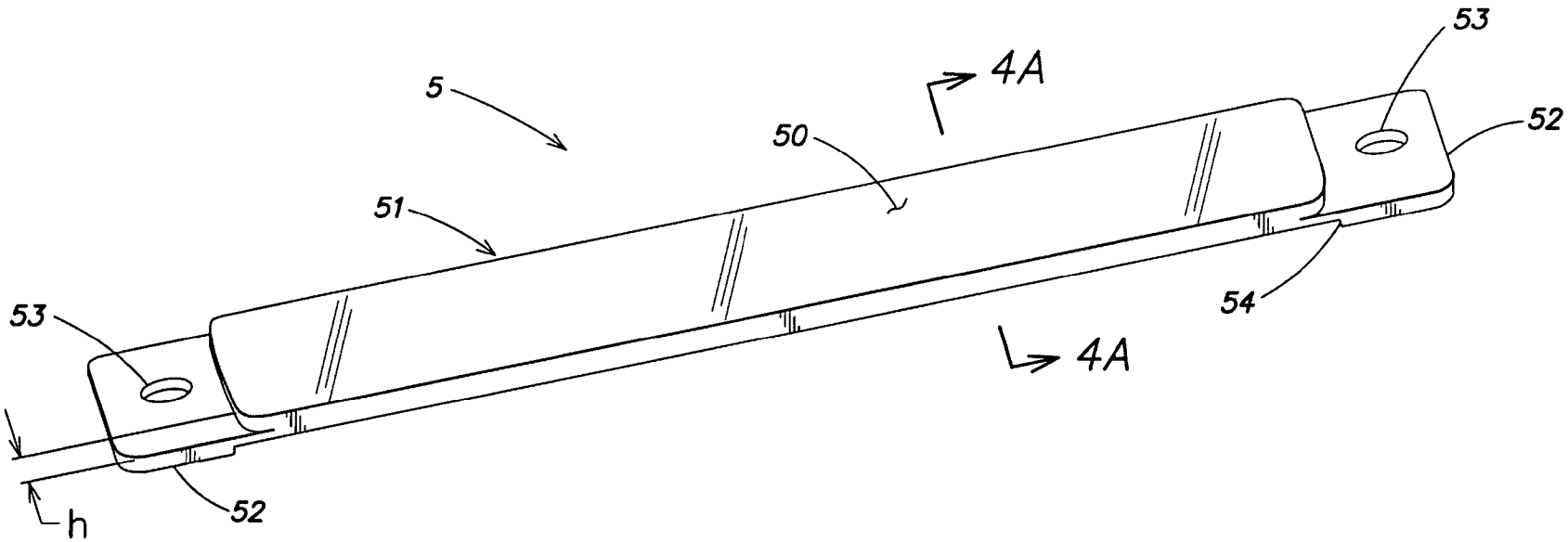
FIG. 4 is a perspective view of a spine window of the binder shown in FIG. 1.

As shown in FIG. 4, the window 5 may comprise a central section 51 and at least one flange 52. The size and shape of the central section 51 may substantially correspond to the size and shape of the cutout 6 in the central section 10 of the spine 4.

The central section 51 may be raised compared to the flange(s) 52. The height difference h between the central section 51 and the flange(s) 52 of the window may substantially correspond to the thickness of the central section 10 of the spine 4 adjacent the cutout 6. In this way, the central section 51 of the window 5 may be placed in the cutout 6 of the central section 10 of the spine 4 such that an outer surface 50 of the window 5 may be substantially flush with the outer surface 44 (see FIG. 3) of the central section 10 of the spine 4.

Figure 3:
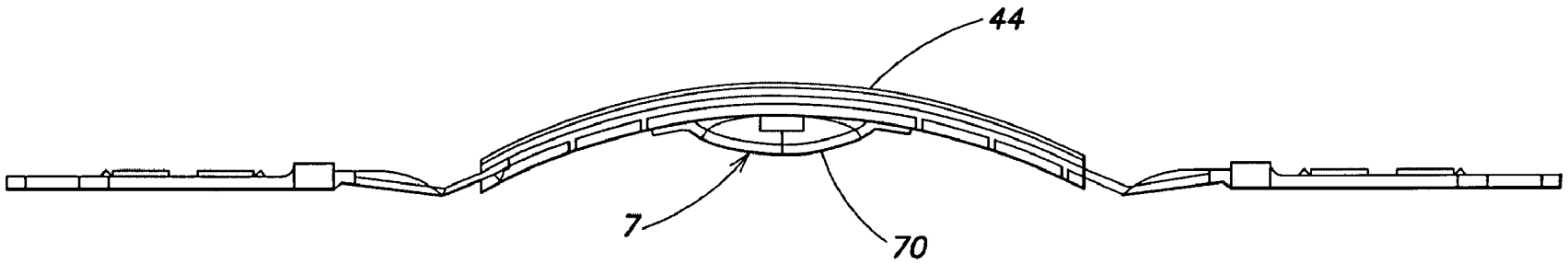
FIG. 3 is an end view of the spine of the binder shown in FIG. 1.
Figure 4A:
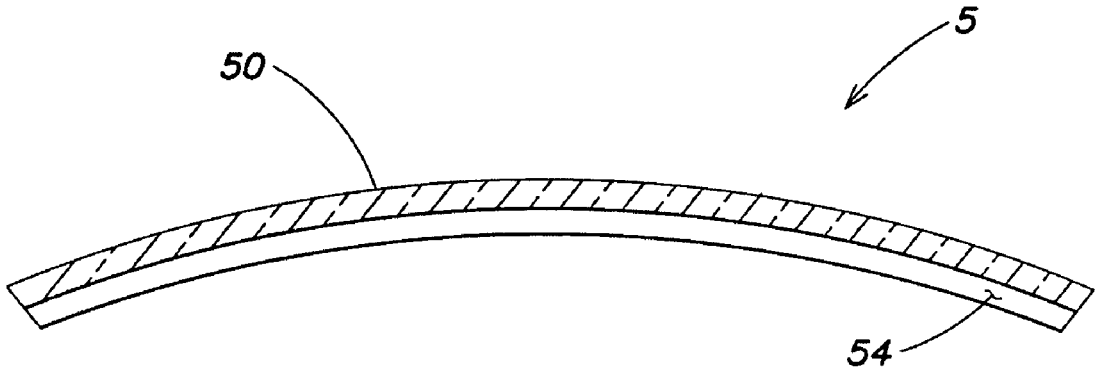
FIG. 4A is a cross-sectional view taken along lines 4A-4A of FIG. 4.

As shown in FIG. 3, the spine 4 may comprise an arcuate profile. Thus, the central section 10 of the spine 4 may not be substantially flat. If this is the case, the outer surface 50 of the window 5 may likewise be arcuate with substantially the same radius of curvature as the central section 10 of the spine 4, as shown in FIG. 4A. As such, the outer surface 50 of the window 5 does not substantially protrude along the outer surface 44 of the spine 4. In other words, the outer surface 50 of the window 5 being "coplanar" or "flush" with the outer surface 44 of the spine 4 does not limit either the window 5 or central section 10 of the spine 4 to having a flat outer surface. Instead, the outer surface 50 of the window 5 substantially follows the curvature of the outer surface 44 of the spine 4 where the window 5 is to be placed.

Additionally, the window 5 may comprise attachment points 53 where the window 5 may be attached to the spine 4 to hold the window 5 in place. In the embodiment of FIG. 4, the attachment points 53 include holes which can be attached to the central section 10 of the spine 4. For example, the hole may mate with and be secured by a post 78 disposed on the spine 4 (see FIG. 2A). Although the attachment points 53 are located at the top and bottom of the window 5 in the FIG. 4 embodiment, the attachment points 53, if any, may be located at any position on the window 5. Additionally or alternatively, the window may be attached to the spine 4 by adhesives, heat bonding, other mechanical fasteners, or any other means. The window 5 may be secured to the spine 4 at discrete attachment points 53, by the flange(s) 52, and/or around the perimeter of the window 5. Any attachment methods, mechanisms, and/or location may additionally or alternatively be used, as the invention is not limited in this respect.

In one embodiment, the window 5 is made from a material such that the label is usable through the window. In one embodiment, the window is formed of clear plastic, such as polycarbonate, acrylic and/or polypropylene. The window 5 may comprise a relatively hard, durable, stiff plastic which will not substantially flex. However, any material or combination of materials may be used as the invention is not limited in this regard.

Figure 2A:
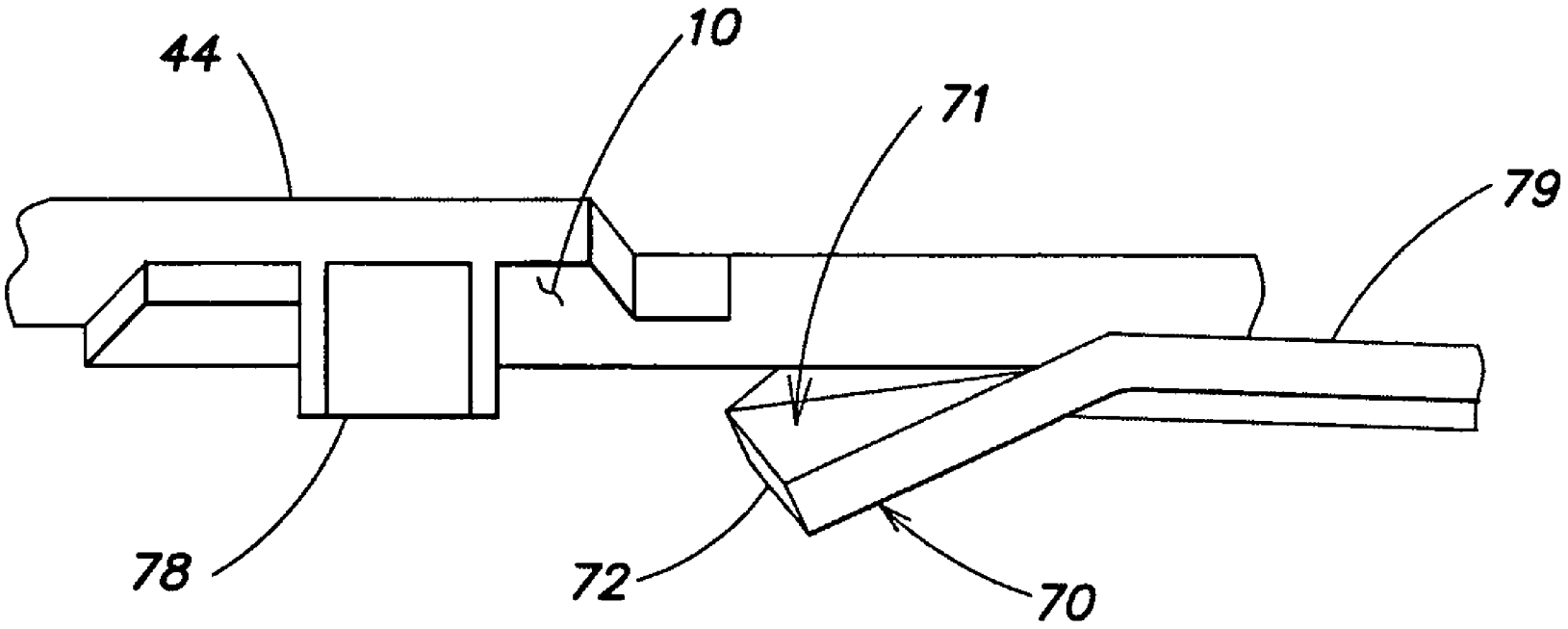
FIG. 2A is an enlarged side view of section A-A of FIG. 2.

As shown in FIG. 2, the central section 10 of the spine 4 may also have at least one tab 7 in the area of the cutout 6 to retain a label adjacent or against the window 5 so that the label is viewable through the window 5. The tab 7 may be recessed behind the outer surface of the majority of the central section 10, as shown in FIG. 2A to create a pocket for the label. In other words, an outer surface 79 of the tab 7 may not be flush with an outer surface 44 of the central portion 10 of the spine 4.

The tab 7 may be connected to the central section 10 of the spine 4. In one embodiment, the tab 7 is integrally formed with the central section 10 of the spine 4, although it does not have to be as the invention is not limited in this respect. The tab 7 may be connected to the central section 10 of the spine 4 in any way. As shown in FIG. 2, the tab 7 may be connected to the spine 4 by a bridge 75. The bridge 75 may additionally connect a second tab 7, opposite the first tab, to the central section 10 of the spine 4. Alternatively, only one tab 7 may be employed, as the present invention is not limited in this regard. Indeed, any number of tabs may be employed as the present invention is not limited in this regard. Any other configuration may alternatively or additionally connect the tab 7 to the spine 4.

The tab(s) 7 may have any orientation. Although the tabs 7 depicted in the Figures permit access to the window 5 from the top and/or bottom, the tab(s) 7 may be formed and connected to the spine 4 such that a label 6 may be loaded from the side or any other location.

In one embodiment, the tab 7 is configured to apply pressure on a label placed between the window 5 and the tab 7. This pressure may prevent the label 5 from slipping out of the pocket. In one embodiment, the tab may be formed from a material which inhibits slippage of the label with respect to the tab 7. The tab 7 may additionally or alternatively prevent slippage of a label by having a sticky coating, roughened surface or any other treatment which would reduce label movement.

Figure 6:
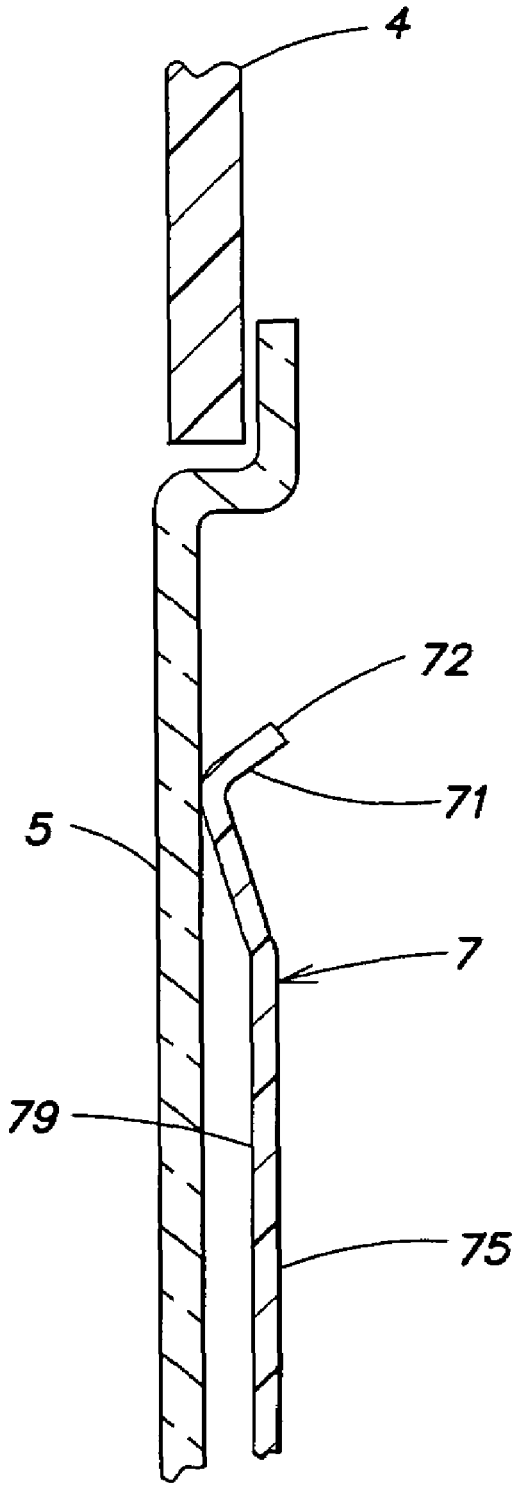
FIG. 6 is a side cross-sectional view of a portion of the spine according to another embodiment.
Figure 7:
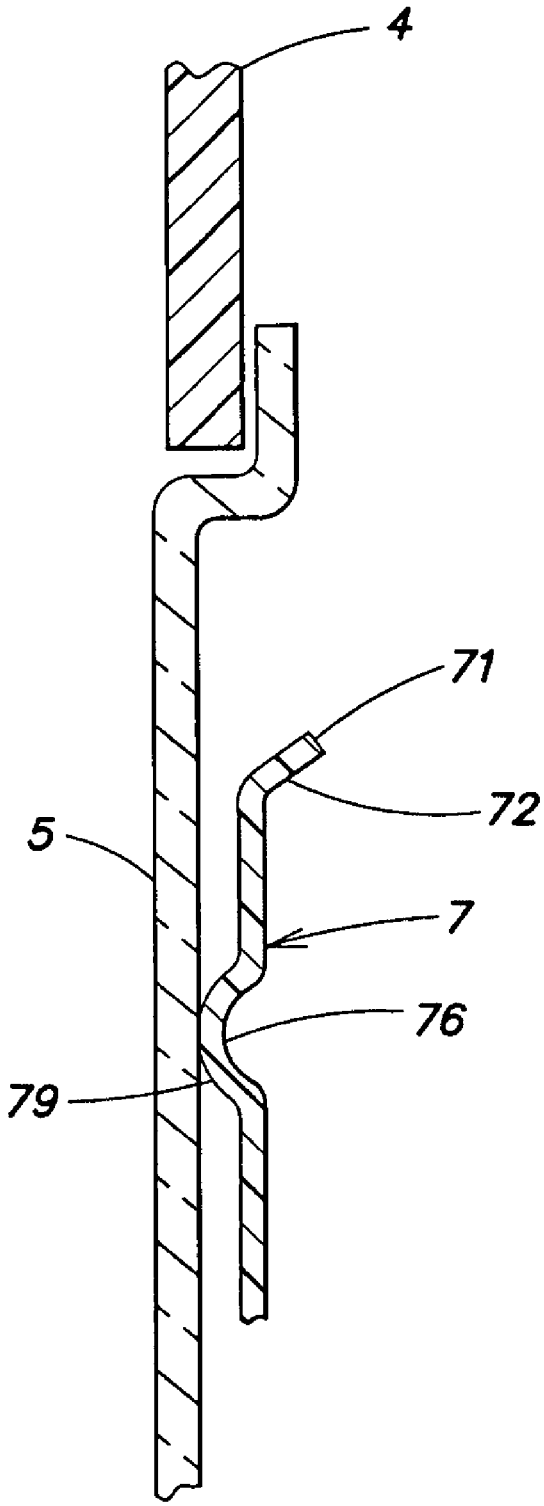
FIG. 7 is a side cross-sectional view of a portion of the spine according to yet another embodiment.

Additionally or alternatively, the shape of the tab 7 may provide an additional force, thereby reducing label slippage. For example, the tab 7 may be curved along its length in order to create a larger biasing force on a label placed between the window 5 and the tab 7. As shown in FIG. 6, the tab 7 may be formed such that a bridge 75 is not coplanar with the free ends 71 of the tab. An outer surface 79 of the tab 7 may protrude towards the window 5 on at least one free end 71. With this configuration, the tab(s) 7 may exert additional pressure on a label placed between the window 5 and the tab 7. In another embodiment and as shown in FIG. 7, the outer surface 79 of the tab 7 protrudes in the central area 76 such that it biases a label 6 against the window 5. A binder 1 according to the invention may have additional or alternative protrusions to bias a label against the window 5, as the invention is not limited in this regard.

Figure 5:
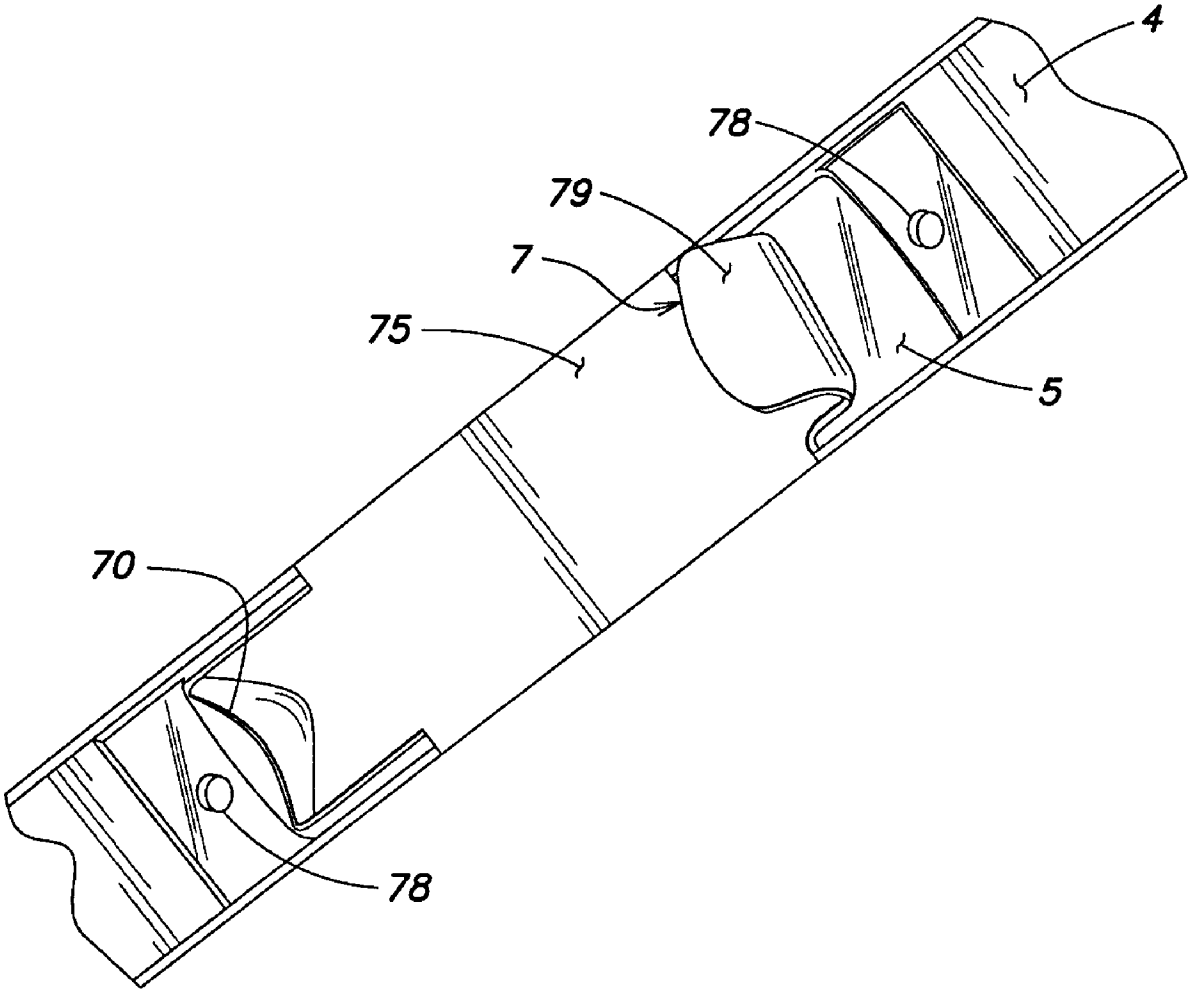
FIG. 5 is a perspective view of the inside of the binder shown in FIG. 1.

In one embodiment, the tab 7 is flexible and bends relatively easily to permit access to the window. The tab 7 may be configured to bend as shown in FIG. 5 and then to rebound back to the position shown in FIG. 2A. In the embodiment shown, the tab 7 is formed integral with the bridge 75 and in the form of a cantilevered element. As such, the tab 7 can flex, as shown. However, the present invention is not limited in this regard, as other suitable arrangements to allow the tab 7 to flex may be employed. For example, the tab 7 may be hinged or otherwise movable away from and towards the window to facilitate loading a label between the window 5 and the tab 7. A separate spring may be employed. It should be appreciated that the tab 7 may not be movable with respect to the window 5 as the invention is not limited in this regard.

As shown in FIGS. 2, 2A, and 3, the tab 7 may also comprise at least one finger hold 70. The finger hold 70 may facilitate loading a label between the tab 7 and the window 5 by providing a space for a user to grab in order to flex the free end 71 of the tab 7 away from the window 5. The finger hold 70 may comprise a flange 72 as shown in FIGS. 2, 2A, and 3. Any other configuration may additionally or alternatively be used. For example, the finger hold 70 may comprise a ring, a pull string, or any other design configured to facilitate user access to the window 5.

The spine 4 may comprise any number of materials, such as polymers and elastomers. For example, in one illustrative embodiment, polypropylene and/or a thermoplastic elastomer is used. However, any material may be chosen as the invention is not limited in this regard. The tab 7 and/or bridge 75, being formed integral with the spine, may also be formed of the same material as the spine.

When configured in this or a similar manner, the tab(s) 7 may act to facilitate loading a label behind the window 5, and/or help retain the label so that it is viewable through the window 5 from the outside of the binder 1.

In one illustrative embodiment, a stop may prevent a label 6 from slipping and/or a user from pushing a label beyond the view of the window 5. Any part of the binder 1 may act as a stop. For example, the window 5 may have an inner lip 54 as shown in FIG. 4, which may prevent a label from slipping beyond the view of the window. Alternatively or additionally, the post 78 which secures the window 5 to the spine 4 may also catch the bottom edge of a label in order to prevent it from slipping beyond the view of the window. There may be any number or type of physical obstacles which act as a stop by preventing or inhibiting a label from slipping. There also may be no physical obstacles serving as a stop, as the invention is not limited in this respect.

The size and location of the window is not limited to the one shown in FIG. 1. The spine may have a larger window that extends over a greater length and/or width, or a smaller window than the one shown in FIG. 1. Alternatively or additionally, the spine 4 may comprise multiple windows. The window(s) may be placed at any location along the length of the spine, as the invention is not limited to the window size and location depicted in or suggested by the Figures.

Other identification means may be used on the binder 1 in addition to the one on the spine 4. For example, the front 2 and/or back 3 panel may have a clear pocket (not shown) in which to place a label or other identifying materials. In this regard, the spine label window and tab configuration described above may be configured for use on either or both of the front and back panels in addition to or instead of on the spine.

The spine and the tab 7 and/or bridge 75 may be formed using any suitable manufacturing processes. In one embodiment, the binder is formed by injection molding techniques. In this embodiment, the spine and tab 6 and bridge 75 are molded together so as to be integrally formed.

In use, to load a label in the window, the binder is opened by opening the front panel. This exposes the interior of a binder 1 to a user. A tab 7 may be flexed toward the user as shown in FIG. 5. The leading edge of a label may be slipped in the gap between the tab 7 and the window 5, and a user may continue to push the label further until it rests on a stop. If a stop is not used, a user may push the label until the label is satisfactorily viewable through the window 5. The bent tab 7 may then be released, which, as explained, may act to secure the label in place. Alternatively, a label may be slipped into the gap between the tab 7 and window 5 without first bending a tab 7 toward the user.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A binder for retaining an item, comprising:

a first panel having a first panel outer surface;

a second panel having a second panel outer surface;

a spine connecting the first panel to the second panel, the spine defining a spine outer surface;

a cutout disposed in at least one of the first panel, the second panel, and the spine;

a window disposed substantially within the cutout;

a tab element disposed adjacent to the cutout, the tab element comprising:

a first flexible tab;

a second flexible tab; and a bridge integrally formed with the first flexible tab and the second flexible tab such that the first flexible tab is disposed in a direction that is substantially opposite the second flexible tab;

wherein the tab element is connected and fixed with respect to an inside surface of the at least one of the first panel, the second panel and the spine, constructed and arranged to receive a label between the inside surface and the tab element;

wherein the first flexible tab has a finger hold constructed and arranged to permit a user to pull the first flexible tab away from both the window and the bridge, and wherein the second flexible tab has a finger hold constructed and arranged to permit a user to pull the second flexible tab away from both the window and the bridge.

2. A binder for retaining an item, comprising:

a first panel having a first panel outer surface;

a second panel having a second panel outer surface;

a spine connecting the first panel to the second panel, the spine defining a spine outer surface;

a cutout disposed in at least one of the first panel, the second panel, and the spine;

a flexible tab disposed adjacent to the cutout; and a window disposed substantially within the cutout, the window comprising:

a window outer surface, the window outer surface being substantially flush with the at least one of the first panel outer surface, the second panel outer surface, and the spine outer surface;

a first window flange defining a height difference between an upper surface of the first window flange and the window outer surface, wherein the height difference substantially corresponds to the thickness of the least one of the first panel, the second panel and the spine panel; and a first window lip extending from the first window flange on a side opposite the upper surface of the window flange in a direction away from the window outer surface, wherein the window lip is configured to prevent movement of a label placed between the window and the flexible tab; and wherein the flexible tab is connected and fixed with respect to an inside surface of the at least one of the first panel, the second panel and the spine, constructed and arranged to receive a label between the inside surface and the flexible tab.

3. The binder of claim 2, wherein the window is secured to the spine at least at a top and a bottom of the window.

4. The binder of claim 2, wherein the flexible tab is integrally molded with the at least one of the first panel, the second panel, and the spine.

5. The binder of claim 2, wherein the flexible tab is constructed and arranged to bias a label against the window.

6. The binder of claim 2, wherein the cutout is disposed in the spine and wherein the window is placed in the cutout of the spine to thereby form a spine label display.

7. The binder of claim 6, wherein the spine and window have an arcuate profile.

8. The binder of claim 2, wherein the at least one of the first panel, the second panel, and the spine has a post and wherein the window has a receiving hole constructed and arranged to receive the post to mount the window.

9. A binder for retaining an item, comprising:

a first panel having a first panel outer surface;

a second panel having a second panel outer surface;

a spine connecting the first panel to the second panel, the spine having a spine outer surface;

a cutout disposed in at least one of the first panel, the second panel, and the spine;

a window disposed substantially within the cutout;

a tab element disposed adjacent to the cut, the tab element comprising:

a first flexible tab facing in a first direction and having a finger hold constructed and arranged to permit a user to pull the first flexible tab away from the window; and a bridge integrally formed with the first flexible tab, the bridge connecting the first flexible tab as a cantilevered element with the at least one of the first panel, the second panel, and the spine, wherein a free end of the first flexible tab extends outwardly away from both the bridge and the window;

wherein the tab element is connected and fixed with respect to an inside surface of the at least one of the first panel, the second panel and the spine, constructed and arranged to receive a label between the inside surface and the tab element.

10. The binder of claim 9, wherein the first flexible tab defines a tab outer surface, and the tab outer surface is recessed with respect to at least one of the first panel outer surface, the second panel outer surface, and the spine outer surface.

11. The binder of claim 9, wherein the first flexible tab is formed integrally with the at least one of the first panel, the second panel, and the spine.

12. The binder of claim 9, wherein the first flexible tab is constructed and arranged to bias a label against the window.

13. The binder of claim 9, wherein the first flexible tab comprises a polymer and/or an elastomer.

14. The binder of claim 9, wherein the cutout is disposed in the spine and wherein the window is placed in the cutout of the spine to thereby form a spine label display.

15. The binder of claim 2, wherein the window further comprises:

a second window flange defining a height difference between an upper surface of the second window flange and the window outer surface, wherein the height difference substantially corresponds to the thickness of the least one of the first panel, the second panel and the spine panel, wherein the second window flange is positioned on a side of the window opposite the first window flange; and a second window lip extending from the second window flange on a side opposite the upper surface of the second window flange, wherein the second window lip is configured to prevent movement of a label placed between the window and the flexible tab.

16. The binder of claim 9, the tab element further comprising:

a second flexible tab connected to the at least one of the first panel, the second panel, and the spine, the second flexible tab disposed adjacent to the cutout facing in a second direction and having a finger hold constructed and arranged to permit a user to pull the second flexible tab away from the window, wherein the second flexible tab is integrally formed with the bridge such that the first direction is substantially opposite the second direction, the bridge also connecting the second flexible tab with the at least one of the first panel, second panel, and the spine.

17. The binder of claim 9, wherein the bridge connects the first flexible tab with the at least one of the first panel, the second panel, and the spine at two spaced apart locations.

18. The binder of claim 1, wherein the bridge connects the first and second flexible tabs with the at least one of the first panel, the second panel, and the spine at two spaced apart locations.

19. The binder of claim 9, wherein the finger hold is constructed and arranged to include an upwardly arched flange configured to provide a curved space for a user to grab to pull the first flexible tab away from the window.

20. The binder of claim 9, wherein the free end of the first flexible tab is not coplanar with the bridge.

* * * * *